US005683127A

United States Patent [19]

Chamberlain

[11] Patent Number: 5,683,127

[45] Date of Patent: Nov. 4, 1997

[54] DEADBOLT LATCH ASSEMBLY

[75] Inventor: L. C. Derek Chamberlain, Colorado Springs, Colo.

[73] Assignee: Schlage Lock Company, San Francisco, Calif.

[21] Appl. No.: 662,741

[22] Filed: Jun. 10, 1996

Related U.S. Application Data

[63] Continuation of Ser. No. 334,100, Nov. 4, 1994, abandoned.

[51] Int. Cl.[6] ..... E05B 9/00

[52] U.S. Cl. ..... 292/337; 70/451

[58] Field of Search ..... 292/327, DIG. 53, 292/DIG. 64, 337; 70/370, 381, 449–451

[56] References Cited

U.S. PATENT DOCUMENTS

| | | | |
|---|---|---|---|
| 2,410,462 | 11/1946 | Schlage | 292/337 |
| 2,983,540 | 5/1961 | Check | 70/450 |
| 3,055,691 | 9/1962 | Kessel | 292/337 |
| 3,190,683 | 6/1965 | Schlage | 292/337 |
| 3,197,247 | 7/1965 | Russell | 292/337 |
| 4,372,594 | 2/1983 | Gater | 292/337 |
| 4,662,665 | 5/1987 | Lin | 292/337 |
| 4,729,585 | 3/1988 | Lin | 292/337 |
| 4,736,973 | 4/1988 | Fang | 292/337 |
| 4,752,090 | 6/1988 | Lin | 292/337 |
| 4,759,576 | 7/1988 | Ching | 292/337 |
| 4,974,883 | 12/1990 | Jans | 70/450 |
| 5,039,146 | 8/1991 | Lin | 292/DIG. 53 |
| 5,094,488 | 3/1992 | Boadwine | 292/DIG. 53 |
| 5,211,432 | 5/1993 | Lin | 292/337 |
| 5,308,131 | 5/1994 | Galindo | 292/337 |
| 5,364,138 | 11/1994 | Dietrich | 292/337 |
| 5,458,382 | 10/1995 | Boadwine | 292/337 |
| 5,474,346 | 12/1995 | Fann | 292/337 |

*Primary Examiner*—Steven N. Meyers
*Assistant Examiner*—Gary Estremsky
*Attorney, Agent, or Firm*—Walter C. Vliet

[57] ABSTRACT

A deadbolt latch assembly having an interlocking front faceplate and a collar which capture a locking tab of the deadbolt housing permitting the rapid field assembly of a selected front face or trim plate by simply engaging intermeshing fingers by rotation of the collar to secure the assembly which thereafter may be driven into an aperture prepared for a door lock.

9 Claims, 3 Drawing Sheets

DEADBOLT LATCH ASSEMBLY

This application is a continuation of application Ser. No. 08/334,100 filed Nov. 4, 1994 now abandoned.

BACKGROUND OF THE INVENTION

This invention relates generally to lock latch assemblies and more particularly to a deadbolt latch housing and faceplate assembly. Door latch assemblies are retained within a suitably prepared door by one of two methods: (a) an essentially rectangular faceplate attached to the latch body and subsequently fixed to the door edge by use of screws; or (b) an essentially circular faceplate with a "ribbed" cylindrical portion. In the latter case the faceplate is attached to the latch body, and the complete assembly is hammered into the edge of the door. The ribs on the cylindrical portion provide an interference fit with the door preparation thus retaining the assembly in the door.

The term "drive-in latch" is frequently used to describe a door latch with a circular faceplate. Having the faceplate attached to the latch body limits trim options and substantially increases inventory requirements of the completed assemblies.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In the present invention this is accomplished by providing a faceplate which is attachable to the latch assembly upon assembly. In one aspect of the present invention this is accomplished by providing a door latch assembly comprising a circular faceplate securing device for a door lock comprising a bolt housing having a positioning projection; a faceplate having an aperture therethrough for receiving a bolt projecting through the bolt housing; a collar surrounding the bolt housing in sliding contact therewith; means for interlocking the faceplate and the collar, and means for capturing the projection on the bolt housing between the faceplate and the collar during interlocking.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
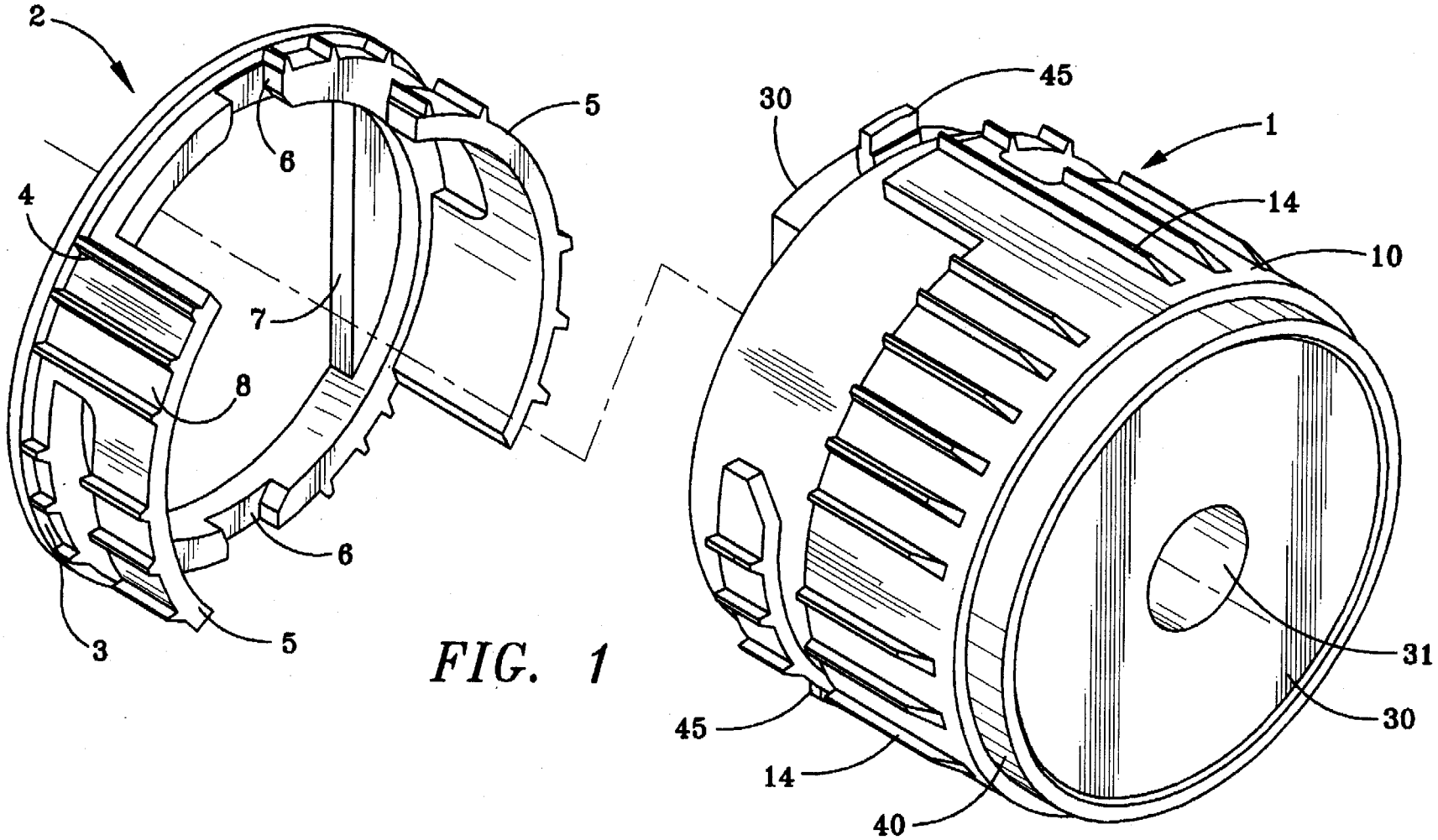
FIG. 1 is an isometric drawing showing the various components of the present invention partially assembled.
Figure 2:
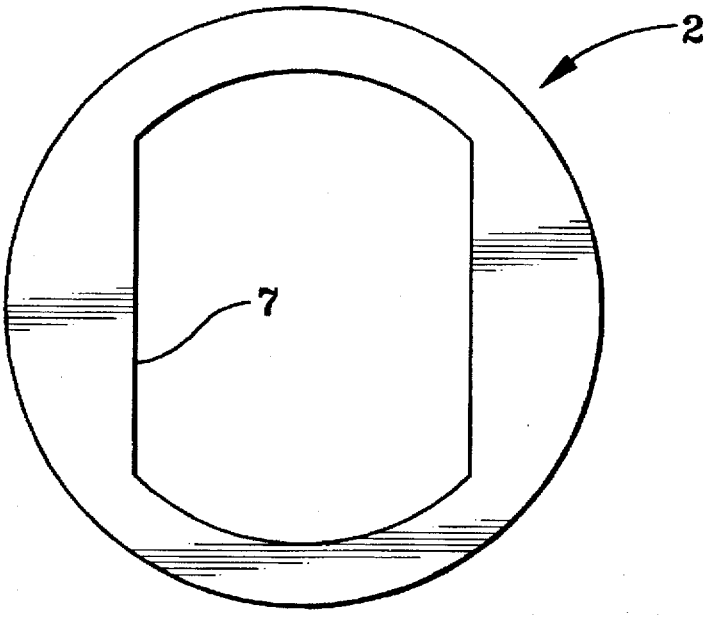
FIG. 2 is a front elevation of a faceplate according to the present invention.

Referring to FIG. 1, which shows a partial assembly isometric of a latch assembly according to the present invention. The assembly is comprised of a front faceplate 2 comprised essentially of a flanged cylinder. The flange 3 is of a greater diameter than the hole in the door preparation which accepts the assembly and the flange effects a limit stop when the completed assembly is installed. The face of the flange has an aperture or bore shaped to accept and through which the bolt member of a dead bolt latch will move. The back of the front faceplate has a number of recesses or notches 6 (typically but not limited to two) into which a mating number of ears or lock tabs 45 on the deadbolt housing 40 will fit. According to the present invention, the ears are bent up tabs or projections 45 formed on the cylindrical deadbolt housing 40.

Figure 3:
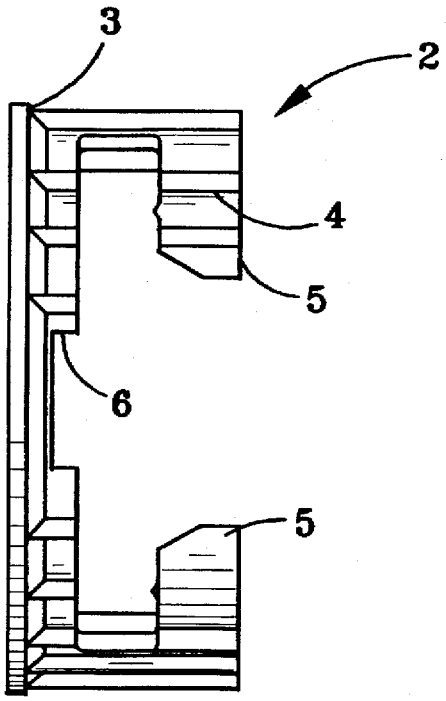
FIG. 3 is a top plan view of a faceplate according to the present invention.
Figure 4:
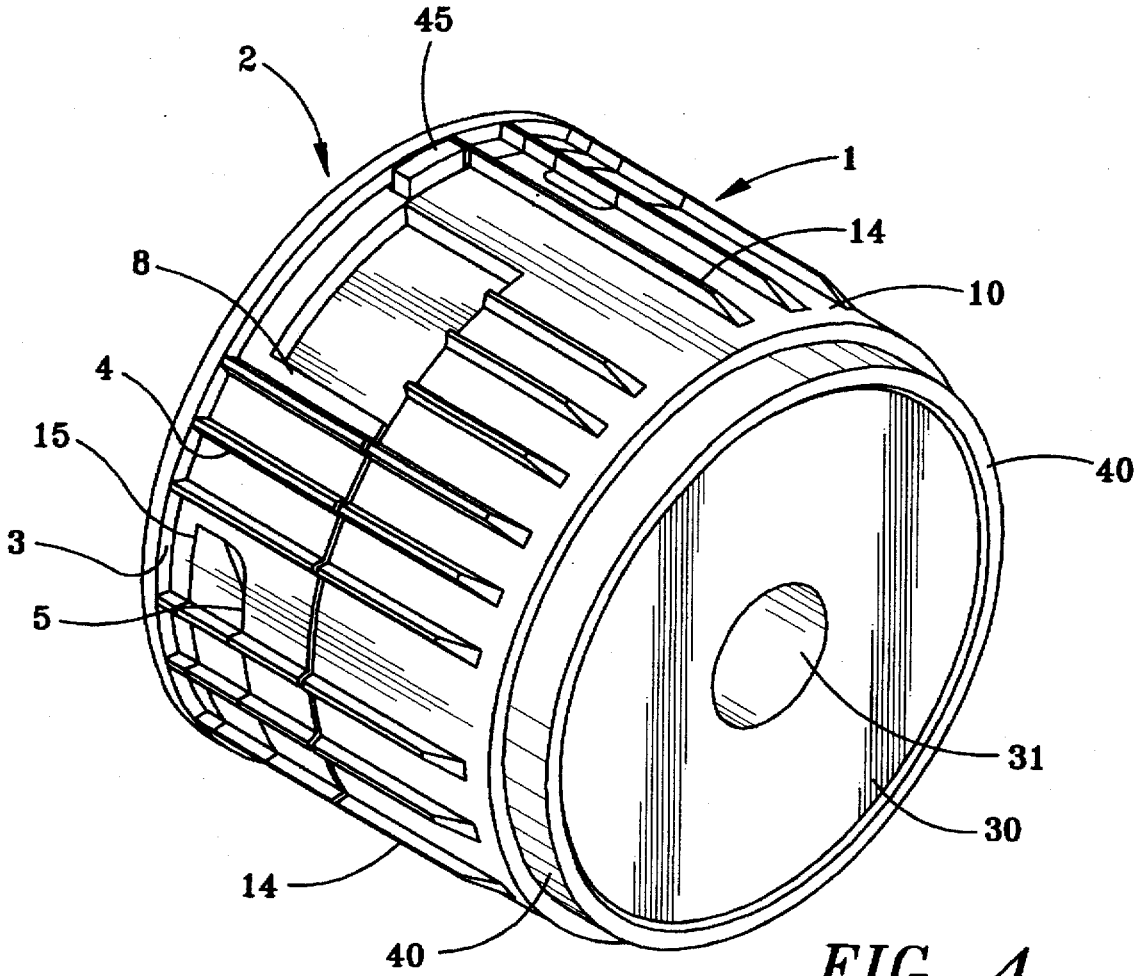
FIG. 4 is an isometric drawing showing the various components of the present invention in fully assembled form.
Figure 5:
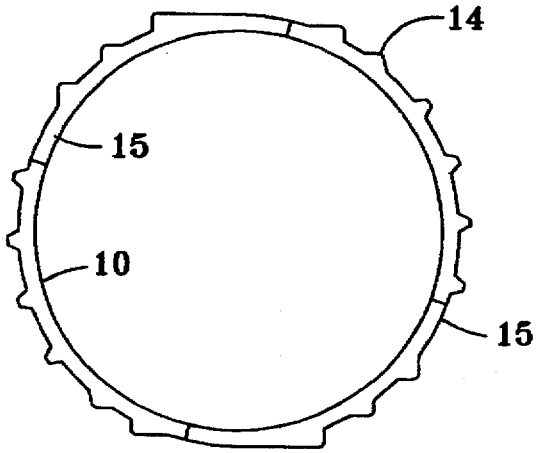
FIG. 5 is a front elevation of the collar according to the present invention, as viewed from the left of FIG. 6.
Figure 6:
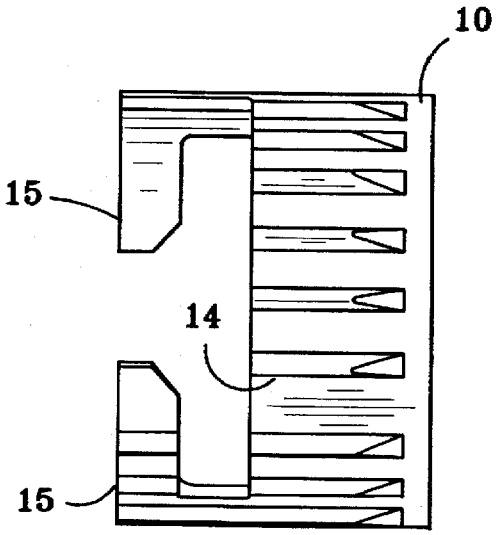
FIG. 6 is a side view of a collar according to the present invention.

A cylindrical portion 8 of the front faceplate 2 extends rearwardly, as best seen in FIGS. 1 and 3. The outside diameter of this portion is sized to fit the hole in the door preparation. Ribs 4 on the outside of the cylindrical portion 8 serve to locally increase the outside diameter and interfere with the door hole. The inside diameter is sized to slide over the cylindrical body of the dead bolt housing 40. The cylindrical portion has "L" shaped cutouts that produce a number of circumferentially oriented lugs or fingers 5 (typically but not limited to the two shown on FIG. 1).

As seen on FIG. 1, an essentially cylindrical collar 10 is provided having inside and outside diameters matching and serving the same function as those of the cylindrical portion of the front faceplate. Ribs 14 or other similar protrusions on the outside of the collar 10 serve to locally increase its outside diameter. The collar 10 also is provided with complimentary "L" shaped cutouts or fingers 15 (the same quantity as the front face) that provide mating lugs for the front faceplate fingers 5.

A deadbolt 30 is reciprocally received within the deadbolt housing 40 and protrudes through the bolt bore 7 in the front faceplate 2. Projection of the deadbolt beyond the front faceplate 2 provides the locking action of the door lock or deadbolt as in the case of the present embodiment. A bore 31 is provided to receive a hardened cylindrical pin which acts to prevent the ready cutting of the bolt 30 by means such as a hacksaw. The pin is not shown.

Upon assembly, the components are oriented, as shown in FIG. 1. The front faceplate 2 is assembled onto the front of the deadbolt with the ears 45 on the deadbolt housing 40 engaging in the recess or notches 6, and with the bolt member 30 protruding through the front aperture 7. The collar 10 is assembled onto the deadbolt housing 40 from the side opposite the front faceplate. Axial motion engages the two sets of lugs or fingers 5, 15, and a rotation of the collar 10 locks the collar 10 to the front faceplate 2. The deadbolt housing 40 and hence the dead bolt 30 reciprocally disposed within the deadbolt housing 40 are thus retained by the ears or lock tabs 45 between the rear of the front faceplate 2 and the collar 10.

The complete assembly is installed in the door preparation (usually a circularly bored hole) by hammering it in until the flange on the front face is flushed with the edge of the door. The ribs 4, 14 on the front faceplate 2 and collar 10 respectively provide an interference fit with the door preparation and prevent easy disassembly.

The use of a removable faceplate 2 allows greater flexibility in the manufacturing process, reduces inventories of completed latch assemblies, and allows the end user greater flexibility since the style of faceplate can be changed in the field to accommodate various installation requirements.

While the invention has been described in terms of a preferred embodiment for a deadbolt latch for illustration, it should be obvious to one skilled in the art that the invention is not limited to deadbolt configurations but will also find use in conventional door knob latch units as well.

Having described the invention in terms of a preferred embodiment, it should now be obvious to one skilled in the art that the same may be varied in many ways without departing from the scope and spirit of the invention. Any and all such modifications are intended to be included within the scope of the following claims:

What is claimed is:

1. A circular faceplate securing device for a door lock comprising:

a bolt housing having a positioning projection;

a faceplate having an aperture therethrough for receiving a bolt projecting through said bolt housing;

a collar surrounding said bolt housing in sliding contact therewith;

means for interlocking said faceplate and said collar;

said means for interlocking said faceplate and said collar further comprises complimentary circumferentially projecting interlocking L-shaped finger projections on said faceplate and said collar which interlock upon relative rotation of said faceplate and said collar upon assembly of said faceplate and said collar about said bolt housing prior to installation in a door bore;

means for capturing said projection on said bolt housing between said faceplate and said collar during interlocking; and means on said faceplate and said collar for securing both said faceplate and said collar against rotation in said door bore and relative rotation between said faceplate and said collar upon insertion in said door bore.

2. A circular faceplate securing device for a door lock according to claim 1 wherein:

said positioning projection further comprises a radial projection.

3. A circular faceplate securing device for a door lock according to claim 2 wherein:

said radial projection further comprises a radially projecting bent tab.

4. A circular faceplate securing device for a door lock according to claim 1 wherein:

said means for capturing said projection on said bolt housing between said faceplate and said collar during interlocking further comprises an aperture provided between said faceplate and said collar.

5. A circular faceplate securing device for a door lock according to claim 4 wherein:

said aperture provided between said faceplate and said collar is a notch in said faceplate.

6. A circular faceplate securing device for a door lock according to claim 1 wherein:

upon assembly said circular faceplate securing device is adapted to be force fit into a bore in a door.

7. A circular faceplate securing device for a door lock according to claim 1 wherein:

said means for preventing rotation of said collar within a door bore further comprises longitudinal projections adapted to increase the diameter of said collar in excess of the diameter of a receiving bore in a door.

8. A circular faceplate securing device for a door lock according to claim 1 wherein:

said means for preventing rotation of said faceplate within a door bore further comprises longitudinal projections adapted to increase the diameter of said faceplate in excess of the diameter of a receiving bore in a door.

9. A circular faceplate securing device for a door lock according to claim 1 wherein:

said bolt housing receives a reciprocating bolt therein which projects through said aperture in said circular faceplate.

* * * * *